US011913300B1

(12) United States Patent
Karakaya et al.

(10) Patent No.: US 11,913,300 B1
(45) Date of Patent: Feb. 27, 2024

(54) WELLBORE CHEMICAL INJECTION WITH TUBING SPOOL SIDE EXTENSION FLANGE

(71) Applicant: Saudi Arabian Oil Company, Dhahran (SA)

(72) Inventors: Mustafa Karakaya, Dhahran (SA); Sohrat Baki, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/180,558

(22) Filed: Mar. 8, 2023

(51) Int. Cl.
*E21B 33/068* (2006.01)

(52) U.S. Cl.
CPC ..... *E21B 33/068* (2013.01)

(58) Field of Classification Search
CPC ..... E21B 33/068
See application file for complete search history.

(56) References Cited

U.S. PATENT DOCUMENTS 3,412,798 A * 11/1968 Gregston ..... E21B 33/068 417/56
4,347,899 A 9/1982 Weeter
6,470,971 B1 10/2002 Bridges
6,695,049 B2 2/2004 Ostocke et al.
8,235,066 B2 8/2012 Dalibey et al.
8,684,073 B2 4/2014 Sevheim et al.
8,746,345 B2 * 6/2014 Kotrla ..... E21B 33/068 166/347
9,500,062 B2 11/2016 Tveiten et al.
10,450,821 B2 10/2019 Guedes et al.
10,502,021 B2 12/2019 Healy
11,454,086 B2 9/2022 Harestad
2018/0010420 A1 1/2018 Shirley et al.
2021/0102437 A1 * 4/2021 Sorensen ..... E21B 33/068
2022/0170343 A1 * 6/2022 Brodie ..... E21B 34/02

* cited by examiner

*Primary Examiner* — Matthew R Buck
(74) *Attorney, Agent, or Firm* — Fish & Richardson P.C.

(57) ABSTRACT

A wellbore chemical injection assembly includes an extension flange including two ends and defining a flange bore. The first end can be fluidically coupled to a tubing spool inlet of a wellhead installed at a wellbore surface. The second end can be fluidically coupled to a chemical reservoir from which chemical is injected through the flange bore into the tubing spool. The assembly includes a mandrel positioned within the extension flange. A portion of the mandrel resides within the flange bore, while a remainder extends out. The mandrel defines an interior opening spanning an axial length of the mandrel. Outer coupling threads formed on the mandrel can removably mate with counterpart threads in the tubing spool inlet. Inner coupling threads formed on an inner surface of a portion of the interior opening can removably mate with coupling threads on a valve assembly removably seated in the interior opening.

20 Claims, 17 Drawing Sheets

WELLBORE CHEMICAL INJECTION WITH TUBING SPOOL SIDE EXTENSION FLANGE

TECHNICAL FIELD

This disclosure relates to wellbore chemical injection and specifically to injection from a surface of the wellbore through a wellhead.

BACKGROUND

Wellbore operations utilize well tools installed within a wellbore formed in a subterranean zone (e.g., a formation, a portion of a formation, multiple formations). Fluids (e.g., drilling mud) used during wellbore formation or hydrocarbons (e.g., petroleum, natural gas, combinations of them) produced through the wellbore after formation and completion can corrode the well tools. Chemicals, such as corrosion inhibitors, scale inhibitors, emulsion preventive inhibitors, asphaltene inhibitor, to name a few, can be injected from a surface of the wellbore into the wellbore (e.g., into a wellbore-tubing annulus) to minimize such corrosive effect of fluids that flow through the wellbore. The chemicals can be injected using a chemical injection assembly that is installed at the surface of the wellbore. The chemical injection assembly can be fluidically coupled to the wellhead, specifically to the wellhead to inject the chemicals through a tubing spool, which is a component of the wellhead.

SUMMARY

This disclosure relates to wellbore chemical injection flange system through tubing spool side outlet port.

Certain aspects of the subject matter described here can be implemented as a wellbore chemical injection assembly. The assembly includes an extension flange including a first end and a second end opposite the first end. The extension flange defines a flange bore between the first end and the second end. The first end can be fluidically coupled to a tubing spool inlet of a wellhead installed at a surface of a wellbore formed through a subterranean zone. The second end can be fluidically coupled to a chemical reservoir from which chemical is injected through the flange bore into the tubing spool. The assembly includes a mandrel positioned within the extension flange. A portion of the mandrel resides within the flange bore. A remainder of the mandrel extends out of the extension flange. The mandrel defines an interior opening spanning an axial length of the mandrel. The assembly includes outer coupling threads formed on an outer surface of the remainder of the mandrel. The outer coupling threads can removably mate with counterpart threads in the tubing spool inlet. The assembly includes inner coupling threads formed on an inner surface of a portion of the interior opening. The assembly includes a valve assembly removably seated in the interior opening. The valve assembly includes valve coupling threads on an outer surface of the valve assembly. The valve coupling threads can removably mate with the inner coupling threads formed on the inner surface of the portion of the interior opening.

An aspect combinable with any other aspect includes the following features. The valve assembly includes a valve seat seated in the interior opening. The valve assembly includes multiple check valves installed in the valve seat. The multiple check valves can permit flow of the chemical in one direction through the interior opening and prevent flow of the chemical in the opposite direction.

An aspect combinable with any other aspect includes the following features. An inner diameter of the portion of the interior opening with the inner coupling threads is greater than an inner diameter of the remainder of the mandrel with the outer coupling threads.

An aspect combinable with any other aspect includes the following features. The valve seat includes a first segment and a second segment. An outer diameter of the first segment is greater than an outer diameter of the second segment. The first segment is seated in the portion of the interior opening with the greater inner diameter. The second segment is seated in the portion of the interior opening with the smaller inner diameter.

An aspect combinable with any other aspect includes the following features. The multiple check valves are installed in the second segment.

An aspect combinable with any other aspect includes the following features. The outer coupling threads form a metal-to-metal seal with the tubing spool inlet.

An aspect combinable with any other aspect includes the following features. The outer coupling threads are Sharp Vee threads or ACME threads.

An aspect combinable with any other aspect includes the following features. The flange bore is oriented parallel to a flow of the chemical into the tubing spool inlet.

Certain aspects of the subject matter described here can be implemented as a method. A valve assembly is installed in an interior opening that spans an axial length of a mandrel by removably mating valve coupling threads on an outer surface of a first segment of the valve assembly with inner coupling threads on an inner surface of a portion of the interior opening. The mandrel with the valve assembly is positioned within a flange bore defined between a first end and a second, opposite end of the extension flange. A portion of the mandrel resides within the flange bore and a remainder of the mandrel extends out of the extension flange. Outer coupling threads are formed on an outer surface of the remainder of the mandrel. The outer coupling threads formed on the outer surface of the remainder of the mandrel are coupled with counterpart threads in a tubing spool inlet of a wellhead installed at a surface of a wellbore formed through a subterranean zone. Chemicals are injected through the mandrel and the valve assembly into the wellbore through the tubing spool inlet.

An aspect combinable with any other aspect includes the following features. A chemicals leaks in the valve seat is determined. In response to determining the chemicals leak in the valve seat, injecting the chemicals through the mandrel and the valve assembly is ceased. The valve assembly is removed from the interior opening by de-coupling the valve coupling threads with the inner coupling threads while retaining the mandrel within the flange bore.

An aspect combinable with any other aspect includes the following features. A chemicals leak is determined in the flange bore. In response to determining the chemicals leak in the flange bore, injecting the chemicals through the mandrel and the valve assembly is ceased. The mandrel is removed through the flange bore while retaining the valve assembly within the interior opening while retaining the flange bore in place.

An aspect combinable with any other aspect includes the following features. To couple the outer coupling threads formed on the outer surface of the remainder of the mandrel with counterpart threads in the tubing spool inlet, the flange bore is oriented parallel to a flow of the chemical into the tubing spool inlet.

An aspect combinable with any other aspect includes the following features. The valve assembly includes a valve seat and multiple check valve that can permit flow of the chemical in one direction through the interior opening and prevent flow of the chemical in the opposite direction. The valve seat is seated in the interior opening. The plurality of check valves are installed in the valve seat.

An aspect combinable with any other aspect includes the following features. An inner diameter of the portion of the interior opening with the inner coupling threads is greater than an inner diameter of the remainder of the mandrel with the outer coupling threads. The valve seat includes a first segment and a second segment. An outer diameter of the first segment is greater than an outer diameter of the second segment. The first segment is seated in the portion of the interior opening with the greater inner diameter. The second segment is seated in the portion of the interior opening with the smaller inner diameter.

An aspect combinable with any other aspect includes the following features. The plurality of check valves are seated in the second segment.

Certain aspects of the subject matter described here can be implemented as a wellbore chemical injection system. The system includes a chemical reservoir storing chemicals to be injected into a wellbore formed in a subterranean zone through a wellhead installed at a surface of the wellbore. The wellhead includes a tubing spool having a tubing spool inlet that can receive the chemicals from the chemical reservoir. The system includes a flowline fluidically coupled to the chemical reservoir. The flowline can flow the chemicals from the chemical reservoir to the tubing spool inlet. The system includes a wellbore chemical injection assembly. The assembly includes an extension flange including a first end and a second end opposite the first end. The extension flange defines a flange bore between the first end and the second end. The first end can be fluidically coupled to a tubing spool inlet of a wellhead installed at a surface of a wellbore formed through a subterranean zone. The second end can be fluidically coupled to a chemical reservoir from which chemical is injected through the flange bore into the tubing spool. The assembly includes a mandrel positioned within the extension flange. A portion of the mandrel resides within the flange bore. A remainder of the mandrel extends out of the extension flange. The mandrel defines an interior opening spanning an axial length of the mandrel. The assembly includes outer coupling threads formed on an outer surface of the remainder of the mandrel. The outer coupling threads can removably mate with counterpart threads in the tubing spool inlet. The assembly includes inner coupling threads formed on an inner surface of a portion of the interior opening. The assembly includes a valve assembly removably seated in the interior opening. The valve assembly includes valve coupling threads on an outer surface of the valve assembly. The valve coupling threads can removably mate with the inner coupling threads formed on the inner surface of the portion of the interior opening.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
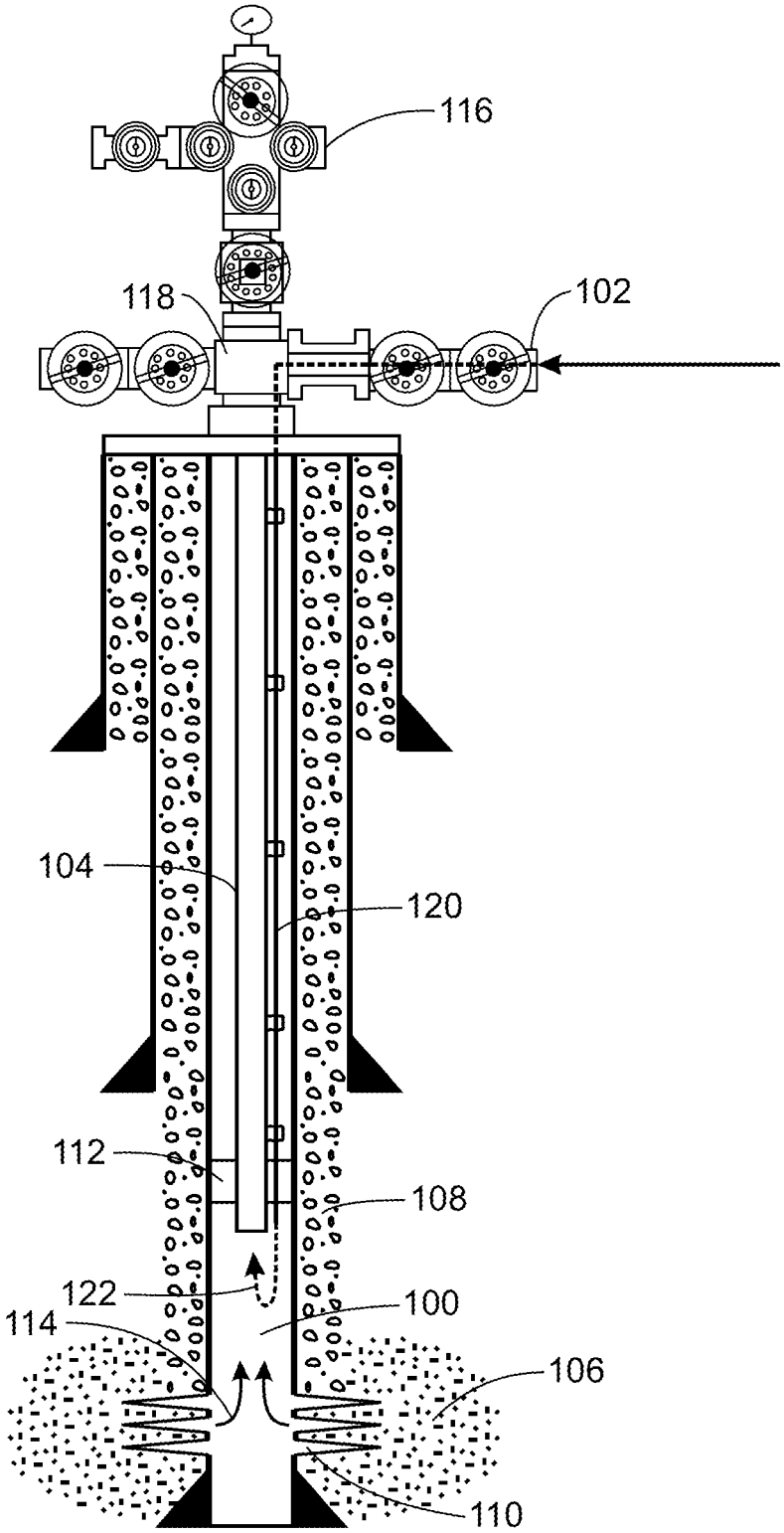
FIGS. 1A, 1B and 1C are examples of different arrangements to inject chemicals into a wellbore using the wellbore injection assembly described in this disclosure.

Hydrocarbons entrapped in subsurface reservoirs flow from the reservoirs through the subterranean zone into the wellbore formed in the subterranean zone. Wellbore equipment are installed within the wellbore to produce the hydrocarbons to the surface. The fluids, e.g., high saline formation brines, various mixtures of oil and mixtures of gas (such as natural gas, hydrogen sulfide, carbon dioxide) that flow into the wellbore through the subterranean zone are extremely corrosive. The wellbore equipment, e.g., tubulars, packers, and the like, can be adversely impacted by the long-term contact with such fluids. For example, the equipment can corrode, or scales or sludges can build up on the equipment or both. The adverse impact on the wellbore equipment, in turn, can impact well production, well integrity, surface production facilities and the like. The adverse impact of the wellbore fluids can be reduced by flowing (i.e., injecting or pumping) chemical inhibitors into the wellbore. The chemicals can be pumped from a surface of the wellbore continuously to downhole locations, specifically to the area of the designed target depth.

This disclosure describes a wellbore chemical injection assembly with an extension flange that can be coupled to a tubing spool inlet of a wellhead of a wellbore formed in a subterranean zone. In some implementations, the assembly includes a mandrel with a thread profile that can be coupled to a counterpart thread profile formed in the tubing spool inlet. The mandrel is installed within the extension flange. The extension flange is a flange that has a similar/same type of pressure rating and connection type for a gate valve connection. The extension flange is designed and constructed to swallow mandrel/seat together while also allowing the injection valve to pass through. The extension flange allows increasing the space between the gate valve and tubing spool side outlet flange.

A valve seat is installed within the mandrel, and a valve set including check valves is installed within the valve seat. The assembly is fluidically coupled to the wellhead such that the mandrel forms a metal-to-metal seal with the tubing spool inlet (e.g., a side outlet port), and the valve seat forms a fluidic seal within the mandrel. Chemicals can be injected into the wellhead through the extension flange. If a leak is detected at the tubing spool inlet-mandrel interface, then the assembly can be detached from the wellhead at the mandrel, and the mandrel alone can be replaced. If a leak is detected in the valve seat-mandrel interface, then the valve seat alone can be replaced. If the injection valve leaks, then the injection valve can be replaced. All these replacements can be done directly if wellhead does not have any positive pressure or can be done through VR plug lubricator systems if the well is under pressure.

In some implementations, the assembly includes an extension flange with an inlet formed on a flange wall (i.e., a side wall that connects an inlet and an outlet). An extension member extends from the flange wall inlet away from the flange wall. A valve seat is installed within the extension member, and a valve set including check valves is installed within the valve seat. In this implementation, there is no thread connection for the valve seat. Instead, the valve seat are included in the body of the chemical injection flange. The flange body has three different sized seats (threads). Each check valve can be installed or removed independently. Deeper check valve seat is smaller in size (near the flange main inner bore). Outer check valve is comparatively bigger. The assembly is fluidically coupled to the wellhead such that chemicals can be injected through the tubing spool inlet. In particular, the chemicals are injected in a direction that is transverse to the end-to-end opening within the extension flange. If a leak is detected in the valve seat-extension member interface, then the valves can be replaced.

Implementations of the subject matter described in this disclosure can improve efficiency and safety of wellbore chemical injection operations by deploying internal fail safe systems. The techniques described here are mechanical solutions that can be deployed with lesser resource consumption compared to smart solutions that implement pneumatic, hydraulic or electrical actuators. The techniques can also increase well integrity in instances that do not require chemical injection from the surface for a duration of time. The arrangement allows chemical injection while keeping side outlet barriers in place and in closed position, while keeping side outlet gate valves in closed position. The arrangement of the valve seat allows easy removal of valves to perform operations such as killing the well, injecting high density brine fluid or performing higher rate injection operations. The assembly can serve as a barrier that facilitates replacing gate valves on the side outlet of the tubing spool. Replacing the mandrel can be performed using valve removal (VR) lubricators.

Figure 1B:
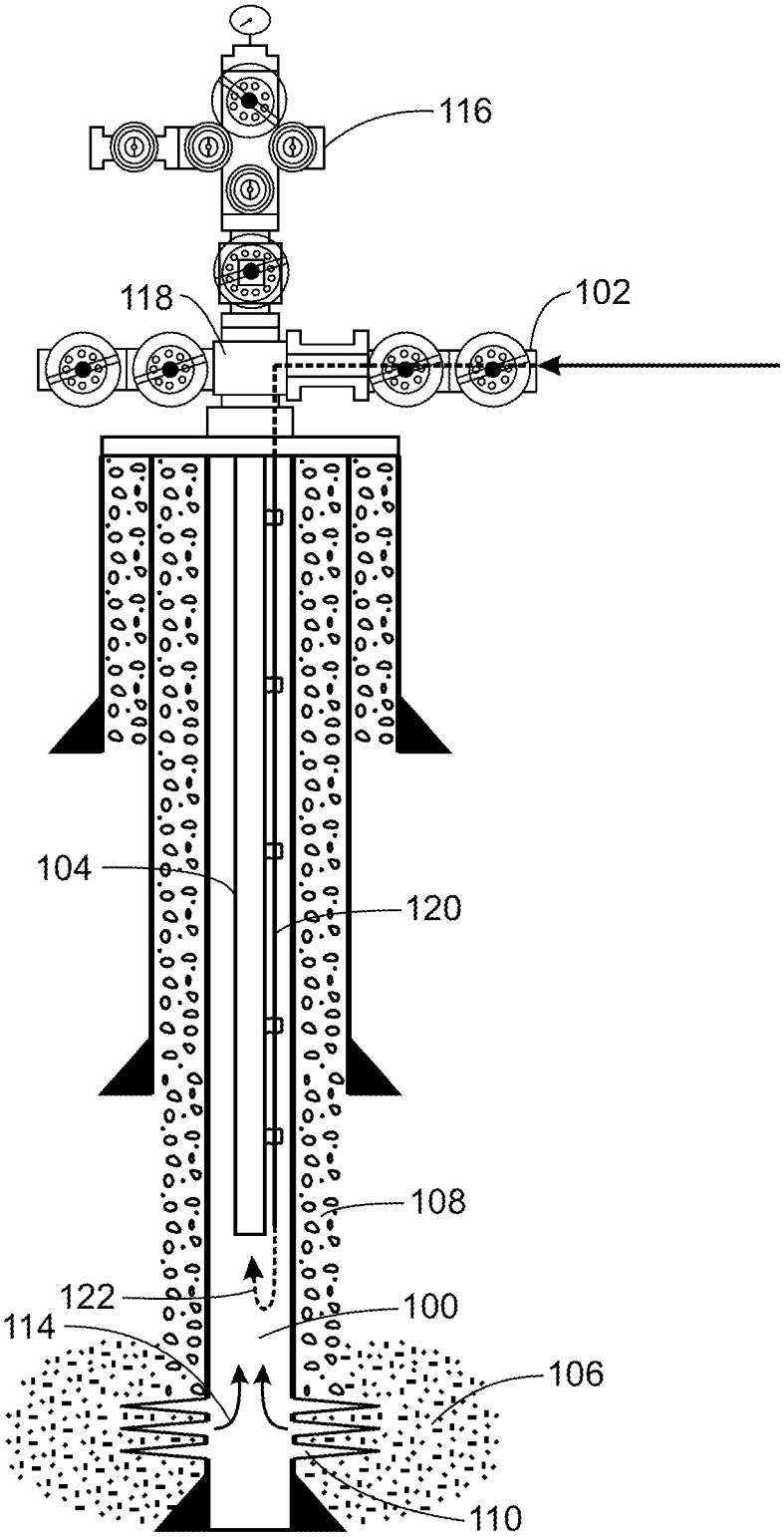
Figure 1C:
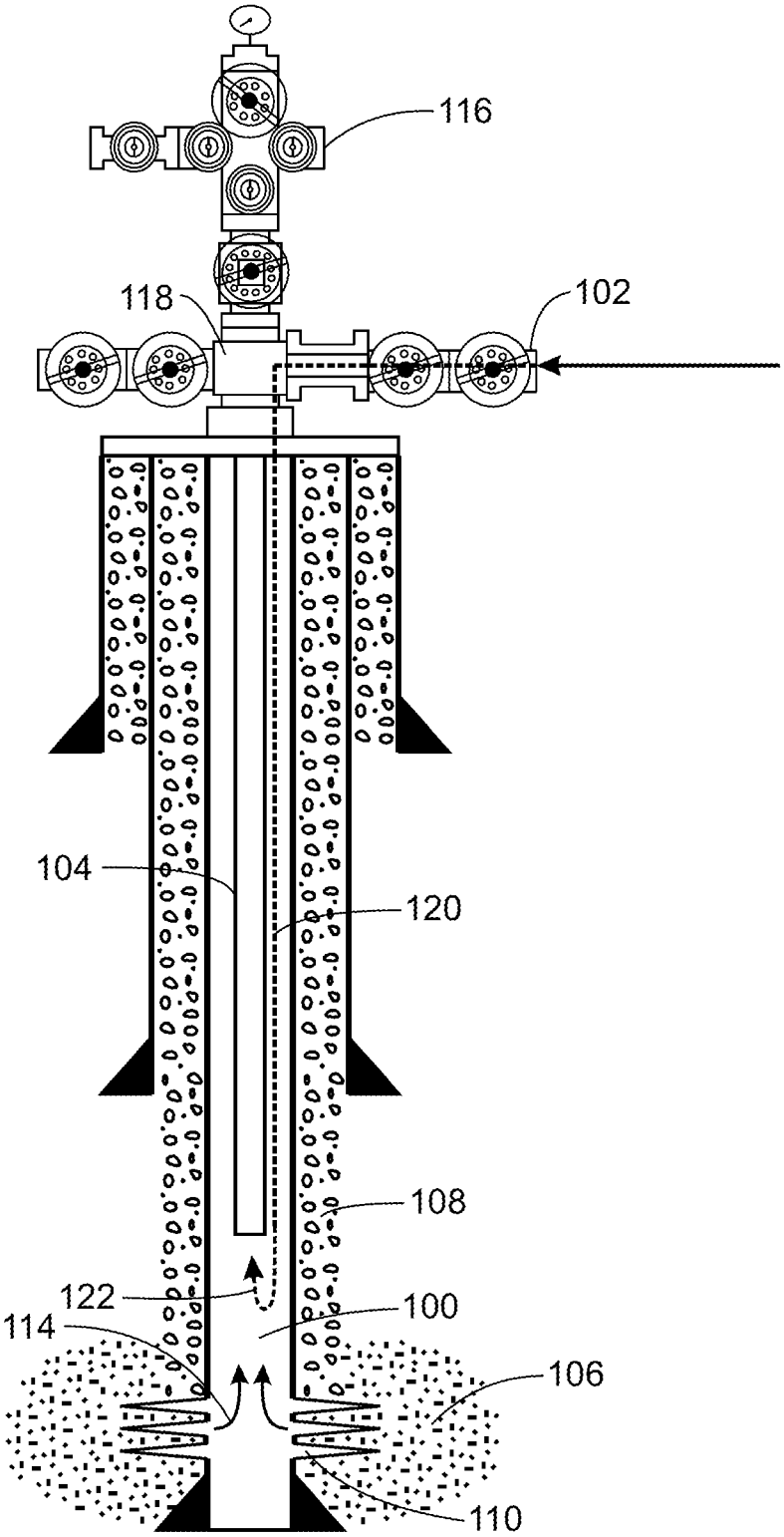

FIGS. 1A, 1B and 1C are examples of different arrangements to inject chemicals into a wellbore 100 using the wellbore injection assembly 102 described in this disclosure. The arrangements can be implemented to inject chemicals into a tubing annulus to transfer the chemicals to downhole locations within the wellbore 100. FIG. 1A shows a schematic arrangement of using the assembly 102 to inject chemicals into a downhole location in the wellbore 100 for flow in an uphole direction through a production tubing 104 to the surface. The wellbore 100 is formed in a subterranean zone 106. The wellbore 100 can be cased and cemented 108 or can be non-cement cased or partially cased. Perforations 110 formed in the wellbore wall allow hydrocarbons to flow from the subterranean zone 106 into the wellbore 100. Packers 112 can be installed near a downhole end of the production tubing 104 to isolate a region of the wellbore 100 below the packers 112 from a region above the packers 112. The hydrocarbons flow from the subterranean zone 106 in an uphole direction (arrows 114) towards a downhole inlet of the production tubing 104 and towards the surface of the wellbore 100.

At the surface, a wellhead can be installed to deploy wellbore equipment (including the production tubing 104, the packers 112, etc.) within the wellbore 100, and also to serve as a connection point for surface equipment. The wellhead can include a wellhead 116, which is a network of fluidic inlets, outlets and flow control equipment (such as valves) to which the wellbore injection assembly 102 is fluidically coupled. In particular, the assembly 102 can be fluidically coupled to an inlet formed in a tubing spool 118 of the wellhead 116. A control line 120 (e.g., a tubing or a pipe) extends from the tubing spool 118 to a downhole location that is downhole of the inlet to the production tubing 104. For example, the control line 120 can pass through an annulus formed by the production tubing 104 and the casing installed in or inner wall of the wellbore 100, and through the packers 112. Chemicals can be injected from the surface of the wellbore 100 through the control line 120 to the downhole location. The injected chemicals are flowed in an uphole direction (arrows 122) by the hydrocarbons and swept into the production tubing 104. As the chemicals flow towards the surface, the chemicals contact the wellbore equipment (such as the inner walls of the production tubing 104) to prevent, reduce or reverse the adverse effects mentioned earlier.

FIG. 1B shows another schematic arrangement of using the assembly 102 to inject chemicals into a downhole location in the wellbore 100 for flow in an uphole direction through a production tubing 104 to the surface. The arrangement of FIG. 1B is substantially identical to that of FIG. 1A, except that the arrangement of FIG. 1B does not implement the packers 122 (FIG. 1A). The arrangement of FIG. 1B allows monitoring annulus pressure behind the production tubing 104, which helps to monitor liquid loading condition of the wellbore 100. FIG. 1C shows another schematic arrangement of using the assembly 102 to inject chemicals into a downhole location in the wellbore 100 for flow in an uphole direction through a production tubing 104 to the surface. The arrangement of FIG. 1C is substantially identical to that of FIG. 1A, except that the arrangement of FIG. 1C does not implement the control line 120 and does not implement packers. Instead, the chemicals are injected from the surface, through the tubing spool 118, directly into the annulus. The chemicals will travel downhole through the annulus and enter the production tubing 104 with the hydrocarbons. The wellbore chemical injection assembly 102 can be used to inject chemicals in any of the arrangements shown in FIGS. 1A-C or other arrangements in which wellbore equipment installed within a wellbore needs to be treated with chemicals injected from the surface.

Figure 2:
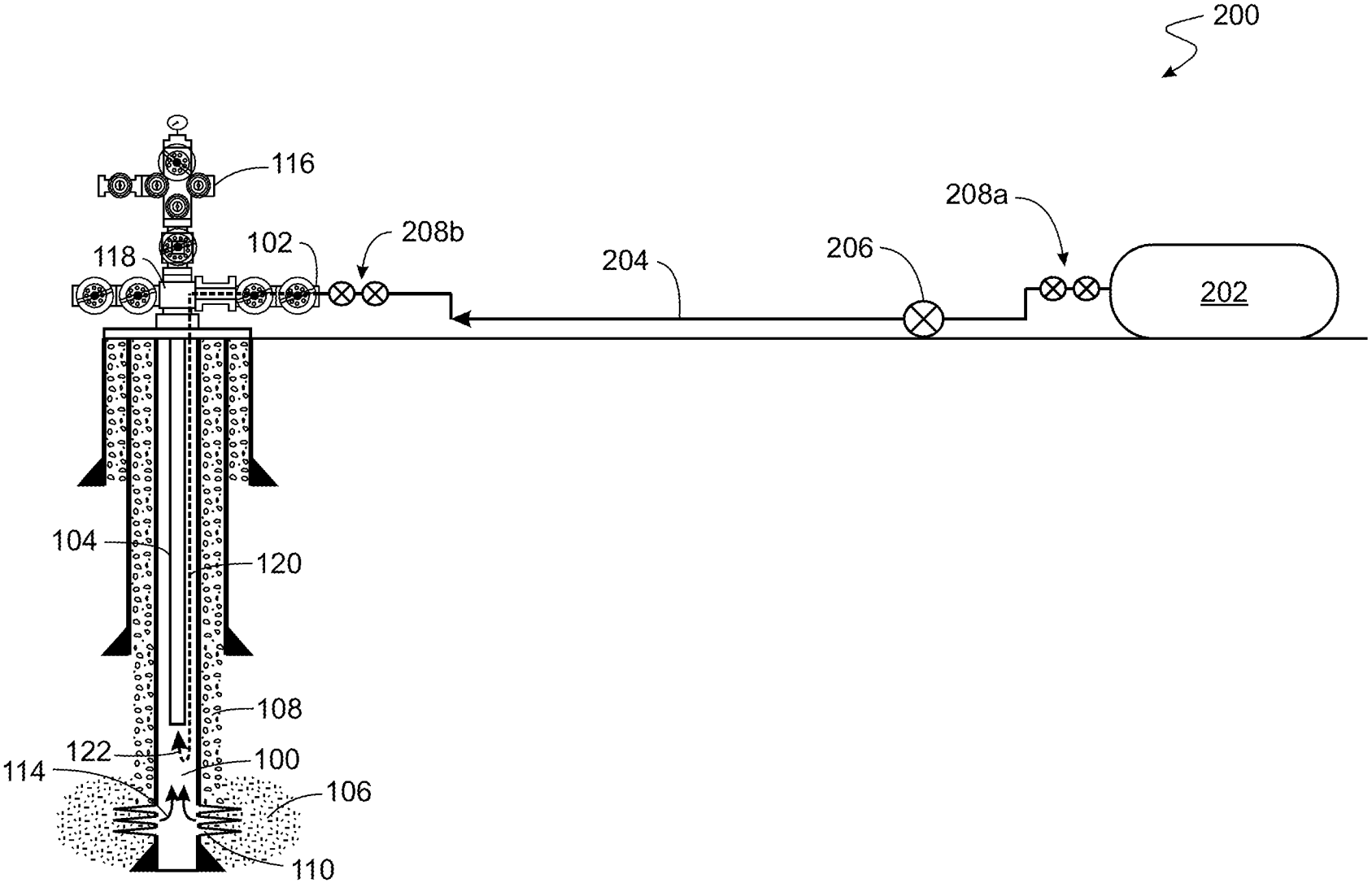
FIG. 2 shows a schematic diagram of a wellbore chemical injection system disposed at a surface of a wellbore.

FIG. 2 shows a schematic diagram of a wellbore chemical injection system 200 disposed at a surface of the wellbore 100. The system 200 is shown as being implemented with the wellbore 100 described with reference to FIG. 1C. However, the system 200 is useable with any of the arrangements shown in FIGS. 1A, 1B and 1C or other arrangements in which wellbore equipment need chemical treatment. The system 200 includes a chemical reservoir 202 (e.g., a tank) that stores the chemical or chemicals to be injected into the wellbore 100. A chemical line 204 (e.g., tubing or pipe) fluidically couples the reservoir 202 to the wellbore injection assembly 102. Flow through the chemical line 204 is implemented using a pump 206 (e.g., a high pressure pump) and flow control equipment (e.g., control valves 208*a*, 208*b*) fluidically coupled along the length of the chemical line 204. One or more of the control valves (e.g., control valves 208*b*) can be installed near and fluidically coupled to the wellbore chemical injection assembly 102. The assembly 102 is fluidically coupled to an inlet of the tubing spool 118 of the wellhead 116.

As described later, the assembly 102 and the tubing spool inlet are coupled using valve removal (VR) plugs. The VR plugs have an American Petroleum Institute (API) Sharp Vee VR profile (called "Sharp Vee") profile that is rated for pressures between 3,000 pounds per square inch (psi) and 10,000 psi. Tubing spools have API standard VR plug profiles. VR plugs do not stay in installed positions in the side outlet ports at all times. In some situations, the VR plugs can be installed and kept in the wellhead. If the VR standard VR plug is installed, they fully isolate the side outlet port.

Figure 3A:
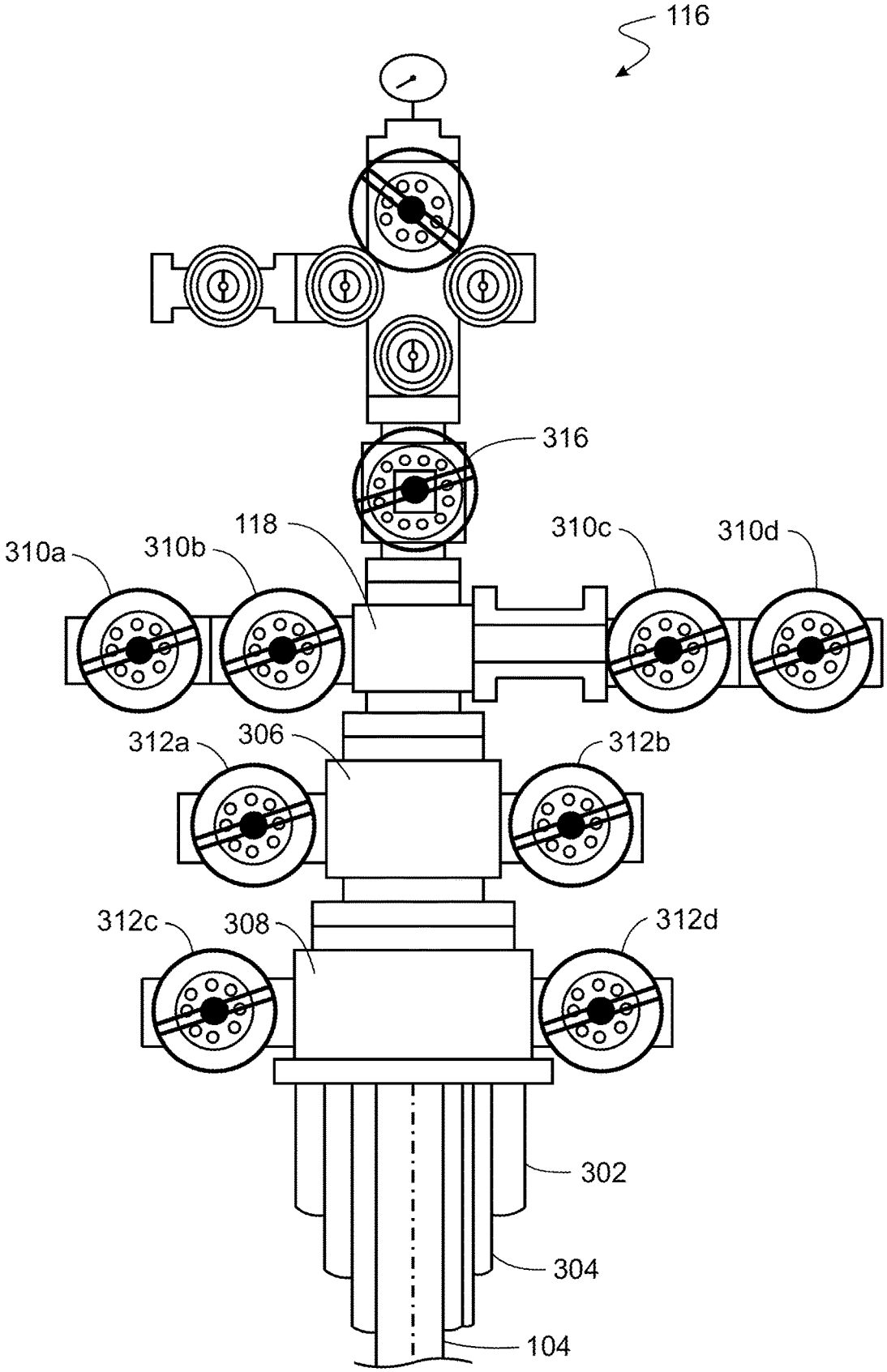
FIG. 3A is a schematic diagram of a wellhead including a tubing spool to which a first implementation of a wellbore chemical injection system is connected.

FIG. 3A is a schematic diagram of a wellhead 116 including a tubing spool 118 to which a first implementation of a wellbore chemical injection system is connected. The wellhead 116 can be attached to different types of tubings installed within the wellbore, e.g., a surface casing 302, an intermediate casing 304, the production tubing 104. The wellhead 116 can include multiple spools including a top tubing spool 118, a first casing spool 306 and a second casing spool 308. Each spool can be fluidically coupled to one of the tubings or casing installed within the wellbore 100. The top tubing spool 118 can be fluidically coupled to the production tubing 104. Each spool can be fluidically coupled to respective gate valves, e.g., gate valves 310*a*, 310*b*, 310*c*, 310*d* fluidically coupled to the top tubing spool 118, gate valves 312*a*, 312*b* fluidically coupled to the first casing spool 306, gate valves 312*c*, 312*d* fluidically coupled to the second casing spool 308. The gate valves coupled to the spools can include outlets that can couple to flow equipment (such as tubings) using which fluid flow into or out of the respective spools can be controlled. A production tree 314 is installed above the top tubing spool 118 and can be fluidically coupled to the top tubing spool 118 through a gate valve 316.

Figure 3B:
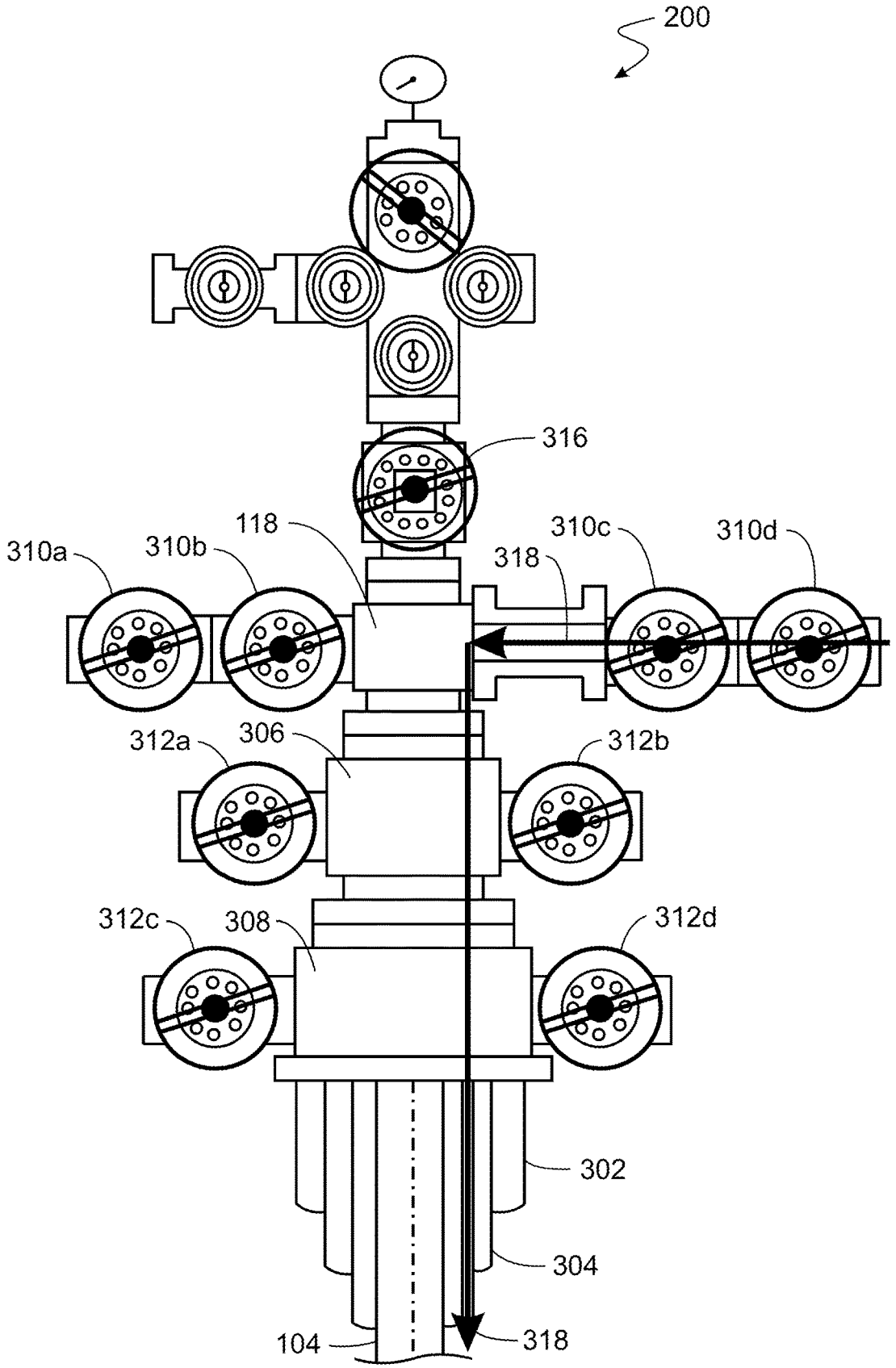
FIG. 3B is a schematic diagram of flowing chemicals through the wellbore chemical injection assembly of FIG. 3A.

In some implementations, the wellbore chemical injection assembly 102 can be fluidically coupled to the top tubing spool 118 between the gate valve 310*c* and an inlet to the tubing spool 118. In alternative implementations, the assembly 102 can be fluidically coupled between the gate valves 310*c* and 310*d*, or the gate valves 310*c* and 310*d* can be fluidically coupled between the assembly 102 and the tubing spool inlet. FIG. 3B is a schematic diagram of flowing chemicals through the wellbore chemical injection assembly of FIG. 3A. Using the wellbore chemical injection assembly 200 (FIG. 2), chemicals from the chemical reservoir 202 (FIG. 2) are flowed through the chemical line 204 (FIG. 2) into the inlet of the tubing spool 118 and into the annulus between the production tubing 104 and the inner wall of the intermediate casing 304, as schematically shown by the arrow 318.

Figure 4A:
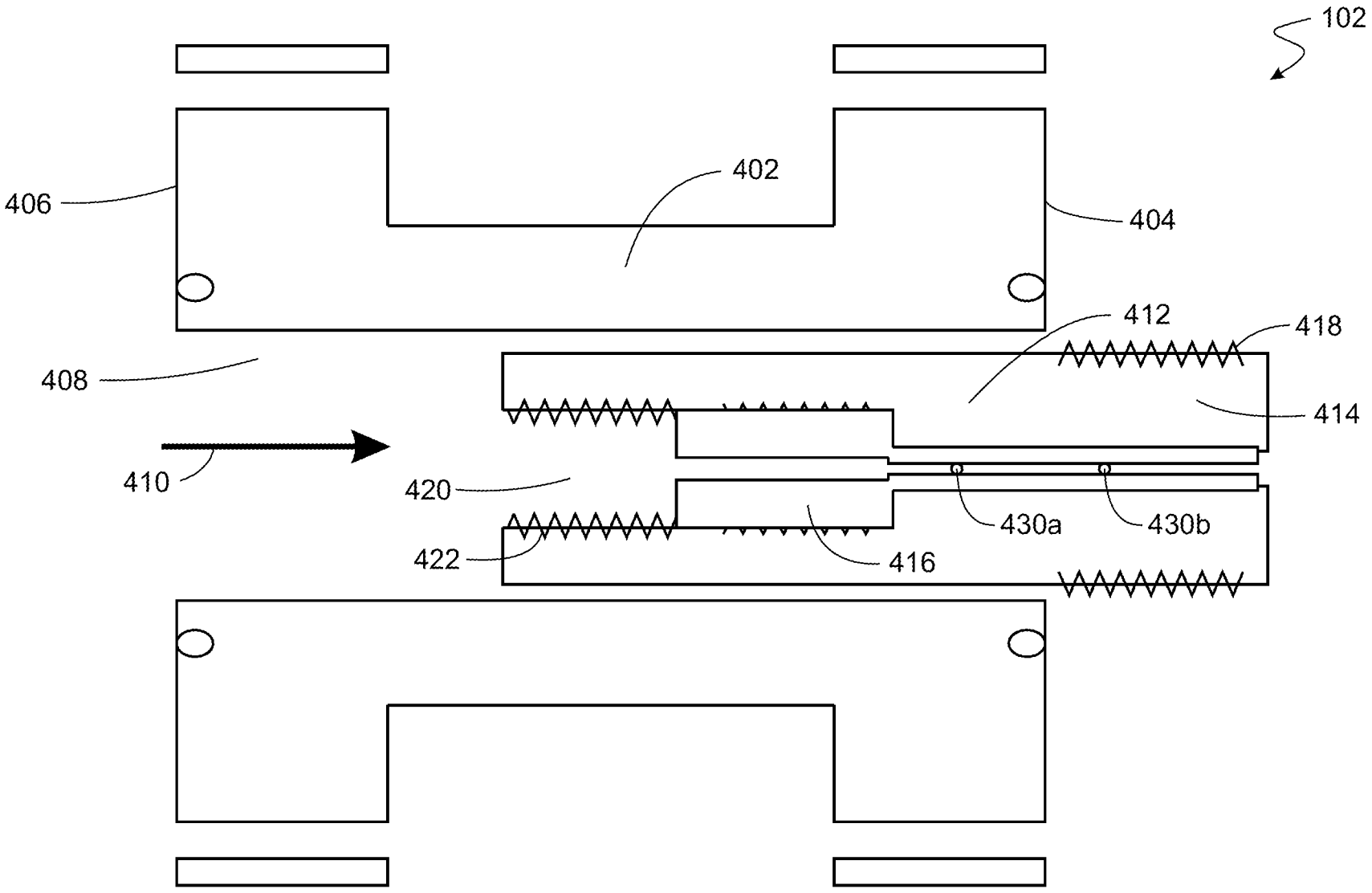
FIG. 4A is a schematic diagram of the wellbore chemical injection assembly implemented in the first implementation.

FIG. 4A is a schematic diagram of the wellbore chemical injection assembly 102 implemented in the first implementation. The assembly 102 includes a flange, mandrel/valve seat and an injection valve. The assembly 102 includes an extension flange 402 having a first end 404 and a second end 406 opposite the first end. The extension flange 402 defines a flange bore 408 between the first end 404 and the second end 406. The flange bore 408 is an open space through which fluid (e.g., chemicals from the chemical tank 202 (FIG. 2)) can flow. The first end 404 is fluidically coupled to an inlet of the tubing spool 118 (FIGS. 1A-1C) of the wellhead 116 (FIGS. 1A-1C). The second end 406 is configured to be fluidically coupled to a chemical reservoir (e.g., the chemical tank 202 (FIG. 2) through the chemical line 204 (FIG. 2)). In some implementations, a gate valve can be installed at the second end 406. Pressure at the tubing spool inlet may necessitate installing one more additional barriers (e.g., gate valves).

Chemicals flowed using the pump 206 (FIG. 2) flow through the assembly 102 by entering the flange bore 408 through the second end 406 and flowing towards the first end 404 as shown by the arrow 410. The ends of the extension flange 402 include openings to secure (e.g., bolt) the extension flange 402 to tubing spool 118 on the first end 404 and to other equipment, e.g., gate valves 310*c*, 310*d* (FIG. 3A), on the second end 406.

The assembly 102 includes a mandrel/valve seat subassembly 412 that includes a mandrel 414 and a valve seat 416. The mandrel 414 is coupled to the tubing spool side outlet port (VR plug profile) negating any direct contact between mandrel/valve seat and extension flange 402. In particular, a portion of the mandrel 414 resides within the flange bore 408. A remainder of the mandrel 414 extends out of the extension flange 402, e.g., past the first end 404. The extension flange 402 covers the mandrel 414.

Figure 4B:
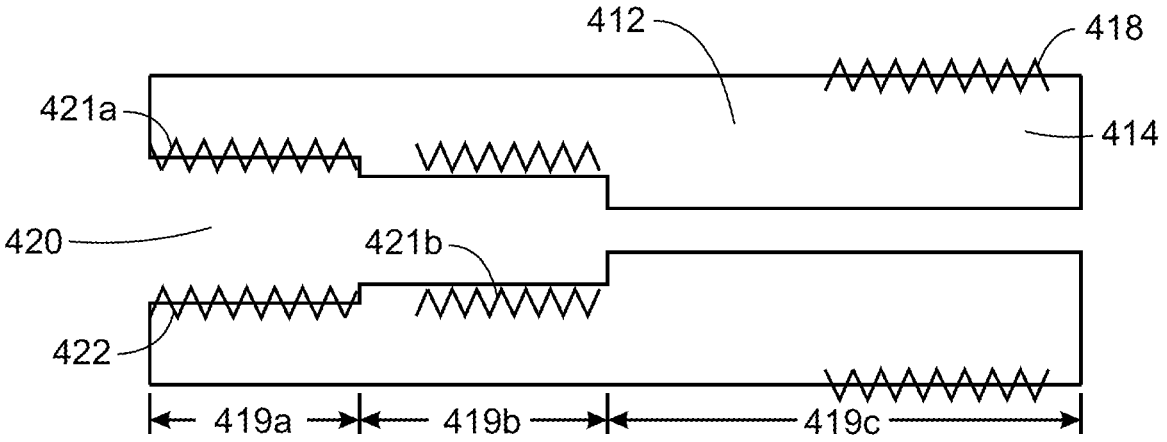
FIG. 4B is a schematic diagram of a mandrel installed within the assembly of FIG. 4A.

FIG. 4B is a schematic diagram of a mandrel installed within the assembly of FIG. 4A. The assembly includes the mandrel or valve seat. The mandrel defines an interior opening 420 that spans an axial length of the mandrel 414. In some implementations, a first length segment of the interior opening 420 has a first inner diameter, and a second length segment (i.e., a remaining of) the interior opening has a second inner diameter smaller than the first inner diameter. In some implementations, the interior opening can have more than two length segments of successively decreasing inner diameters.

Outer coupling threads 418 are formed on an outer surface of the portion of the mandrel 414 that extends out of the flange bore 408 past the first end 404. The outer coupling threads 418 can removably mate with counterpart threads in the tubing spool inlet. By removably couple, it is meant that, when portion of the mandrel 404 with the outer coupling threads is inserted into the portion of the tubing spool inlet with the counterpart threads, the mandrel 404 and the tubing spool inlet form a seal, e.g., a metal-to-metal seal or similar seal that fluidically seals the outer surface of the mandrel 404 to the inner surface of the tubing spool inlet. For example, the outer coupling and counterpart threads can be API standard Sharp Vee threads or ACME threads.

To reverse the mating, the mandrel 414 can be pulled out of the tubing spool inlet, e.g., using a VR plug lubricator system, which can remove the mandrel even when the connection is under fluidic pressure. A VR lubricator system is used to replace valves such as a side outlet valve, annular valve or wing valve on the tubing spool of a wellhead. The VR lubricator system is mounted on the outlet flange of the gate valve (e.g., the gate valve 312*d*) and operated to install/remove the VR plug through the extension flange bore. The VR lubricator system can be operated hydraulically or manually. The VR lubricator system includes a cylinder and an internal rod. The VR lubricator system works by exerting pressure into the cylinder causing the rod to move inward or outward like a hydraulic piston.

In some implementations, the length segment of the interior opening with the smallest inner diameter can also have the outer coupling threads 418 on the outer surface. Conversely, the length segment of the interior opening with the largest inner diameter can have no threads formed on the outer surface. Instead, that length segment can have inner coupling threads 422 formed on an inner surface of the interior opening 420. In the schematic shown in FIG. 4B, the interior opening 420 of the mandrel 414 includes three length segments of decreasing diameter—length segment 419*a*, length segment 419*b*, length segment 419*c*, axially connected to each other to form the axial length of the mandrel 414. The inner surface of the length segment 419*a* includes coupling threads 421*a* (e.g., left-handed ACME threads). The inner surface of the length segment 419*b* includes coupling threads 421*b* (e.g., right-handed ACME threads). The last length segment of the mandrel 414 that connects to the tubing spool inlet (the length segment 419*c* in FIG. 4B) does not have any coupling threads on the inner surface.

Figure 4C:
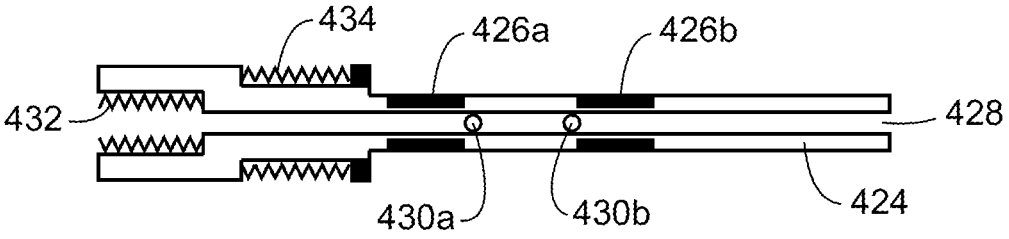
FIG. 4C is a schematic diagram of a valve seat installed within the assembly of FIG. 4A.

FIG. 4C is a schematic diagram of a valve 424 installed within the assembly 102. The assembly includes the injection valve. The valve 424 is a component of a valve assembly installed within the interior opening 420 defined along the axial length of the mandrel 414. The valve 424 has an axial length made up of length segments of different outer diameters, each outer diameter of a valve seat length segment complementing a corresponding inner diameter of a length segment of the mandrel defining an interior opening 420. Thus, when the valve 424 is installed within the interior opening 420, each length segment of the valve 424 fits snugly within a corresponding length segment of the interior opening 420. In addition, each valve seat segment can include seals (e.g., seals 426*a*, 426*b*) to form a fluidic seal between an outer surface of the valve seat segment and the corresponding length segment of the interior opening 420 in which the valve seat segment is installed.

The valve 424 can further define an interior opening 428 through which injected chemicals can flow into the tubing spool inlet. Multiple valves (e.g., two check valves 430*a*, 430*b* (also shown in FIG. 4A) or more check valves) can be installed within the interior opening 428 of the valve 424 to permit injected chemicals to flow towards the tubing spool inlet but not in the opposite direction. The valve 424 can be removably mated to the interior opening 420 of the mandrel 414. To do so, an inner surface of the interior opening 428 in a length segment of the valve seat with the greatest outer diameter (which length segment is farthest from the tubing spool inlet) can include coupling threads 432 (e.g., left-handed ACME threads or other coupling threads) to mate to corresponding threads on the inner surface of the interior opening 420 of the mandrel 414 (e.g., to threads 421*a*). An outer surface of the valve 424 can also include coupling threads 434 (e.g., right-handed ACME threads or other coupling threads) to mate to corresponding threads 421*b* on the interior opening 420 of the mandrel 414. Such coupling forms a fluidic seal between the outer surface of the valve 424 and the inner surface of the interior opening 420. The fluidic seal is strengthened by the sealing elements 426*a*, 426*b*. To de-couple, the valve 424 can be axially pulled out of the interior opening 420.

Figure 5:
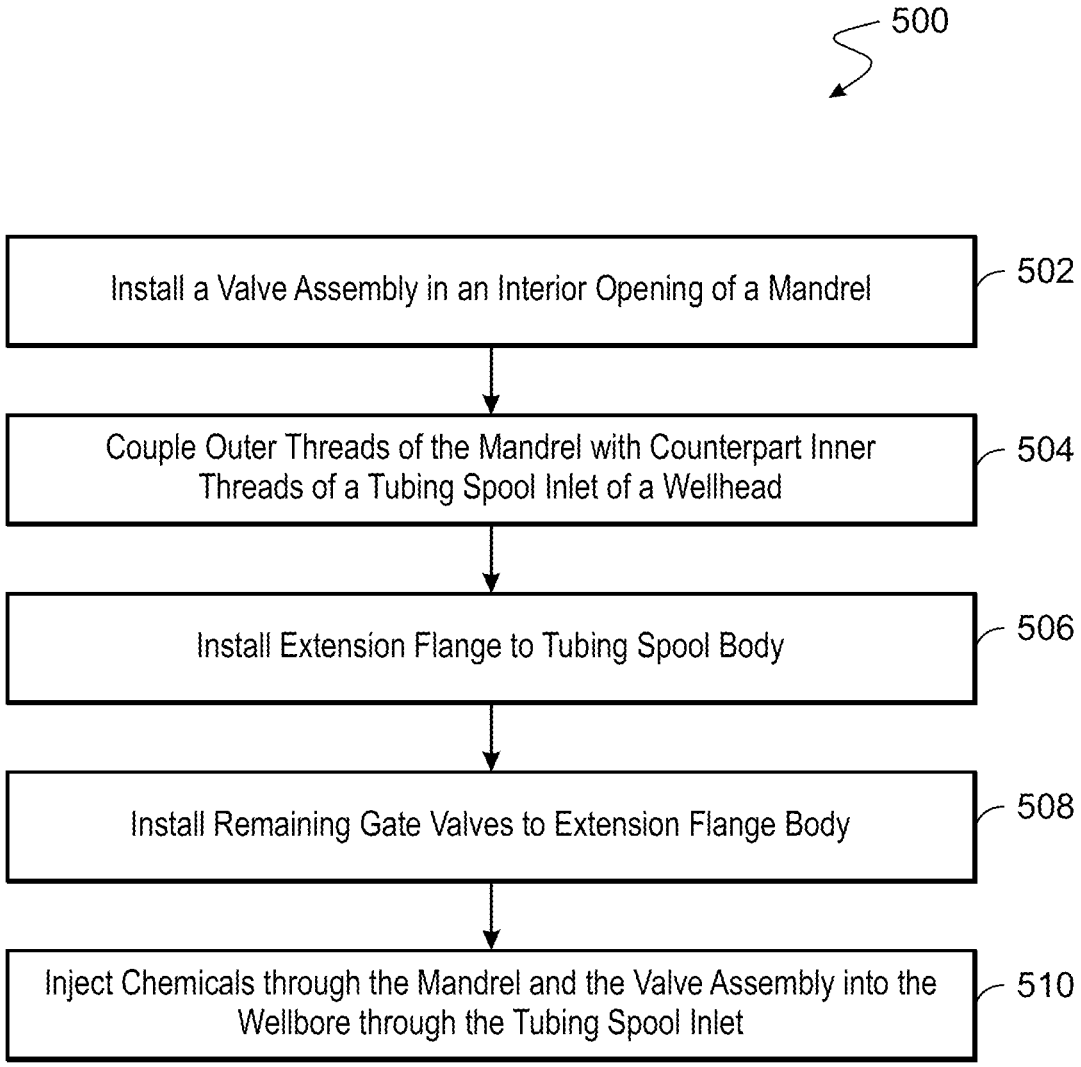
FIG. 5 is a flowchart of an example of a process of implementing the wellbore chemical injection assembly of FIG. 3A.

FIG. 5 is a flowchart of an example of a process 500 of implementing the wellbore chemical injection assembly of FIG. 3A. The process 500 can be implemented by a well operator. At 502, a valve assembly (e.g., the valve assembly including the valve seat 420 with the multiple check valves 430*a*, 430*b*) is inserted into the interior opening 420 that spans the axial length of the mandrel 414. In particular, valve coupling threads (e.g., 434) on an outer surface of a first segment (e.g., the length segment 419*b*) with inner coupling threads (e.g., threads 422) on an inner surface of a portion of the interior opening 420. At 504, the outer coupling threads 418 are coupled with counterpart threads in an inlet of the tubing spool 118 of the wellhead 118 installed at a surface of the wellbore 100. At 506, the flange bore 408 is installed to the tubing spool body. At 508, the remaining gate valves are installed the flange bore 408. As described earlier, the gate valves are installed directly in the tubing spool side outlet port VR profile. The installation can be made through existing tubing spool gate valve inner bore with VR lubricator. The installation can be made directly to tubing spool without any gate valve or extension flange if there is no pressure. If extension sub is previously installed on the tubing spool with one or two gate valves and extension flange with VR plug lubricator, either under pressure or zero pressure. At 510, chemicals are injected through the mandrel 414 and the valve assembly into the wellbore through the tubing spool inlet. In some implementations, the chemicals flow from axial end to axial end along the longitudinal axis of the extension flange 402.

During operation, if a chemicals leak is detected in the valve 424, then the injection of chemicals through the mandrel and the valve assembly is ceased, e.g., by turning off the HP pump 206 (FIG. 2). Then, the valve assembly can be removed from within the interior opening 420 by de-coupling the valve coupling threads (e.g., threads 434) from the inner coupling threads (e.g., threads 418) of the mandrel 414. This operation can be performed with VR plug standard lubricator through gate valve and extension flange. The operation can be performed without requiring to rig down extension flange or any of the gate valves. In particular, the valve assembly can be removed without needing to de-couple the mandrel 414 from the tubing spool 118. Also, during operation, if a chemicals leak is detected in the flange bore 408, then too, the injection of chemicals is ceased. Then, the mandrel 414 is removed from the flange bore 408 while retaining the valve assembly within the interior opening 420. For example, without removing the valve 424 from within the interior opening 420, the extension flange 402 can be separated from the tubing spool 118, and the mandrel 424 can be de-coupled from the tubing spool inlet. In this manner, depending on the location of the leak, a component responsible for the leak can be replaced without needing to replace the entire chemical injection assembly.

Figure 6A:
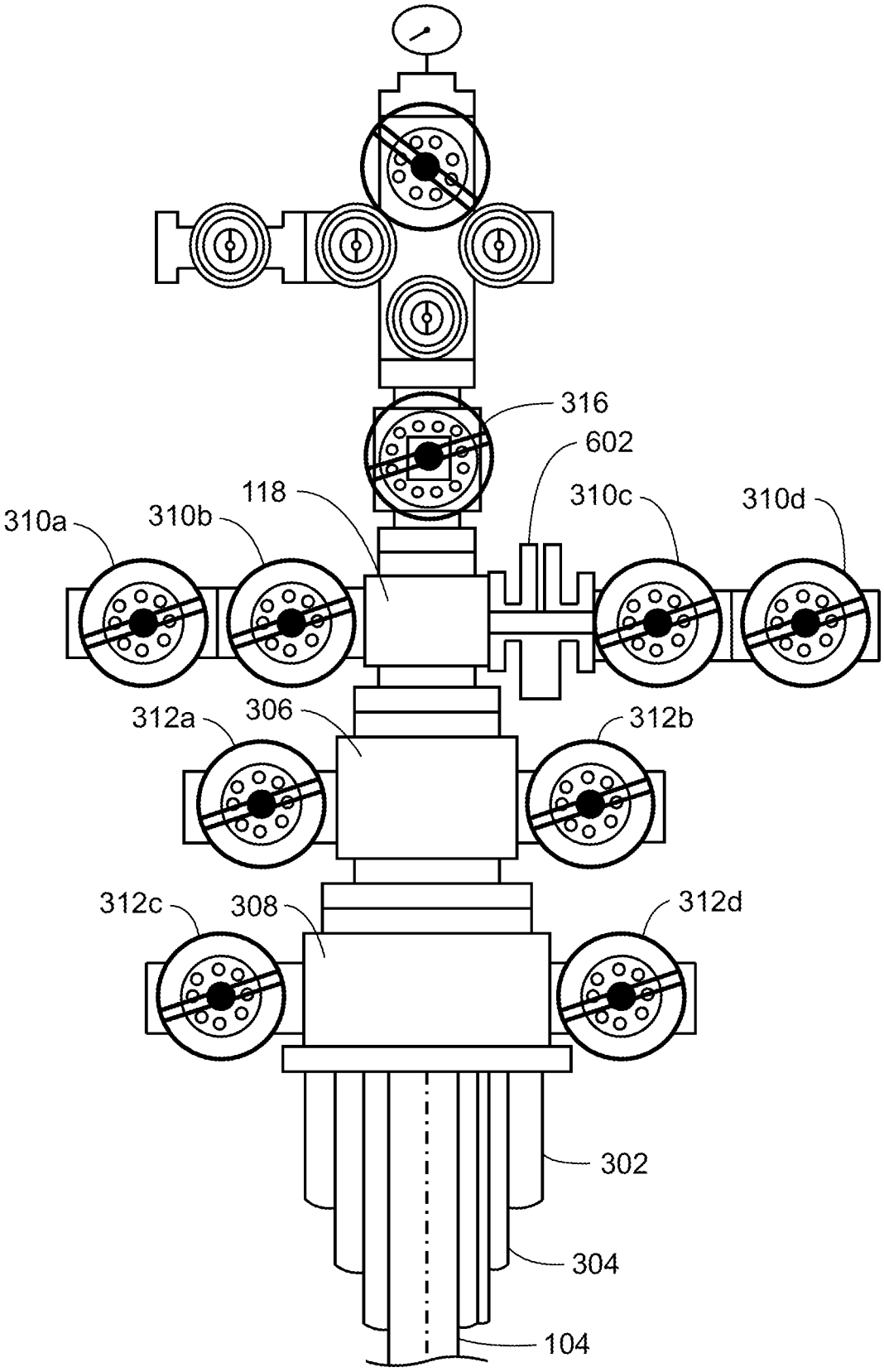
FIG. 6A is a schematic diagram of a wellhead including a tubing spool to which a second implementation of a wellbore chemical injection system is connected.
Figure 6B:
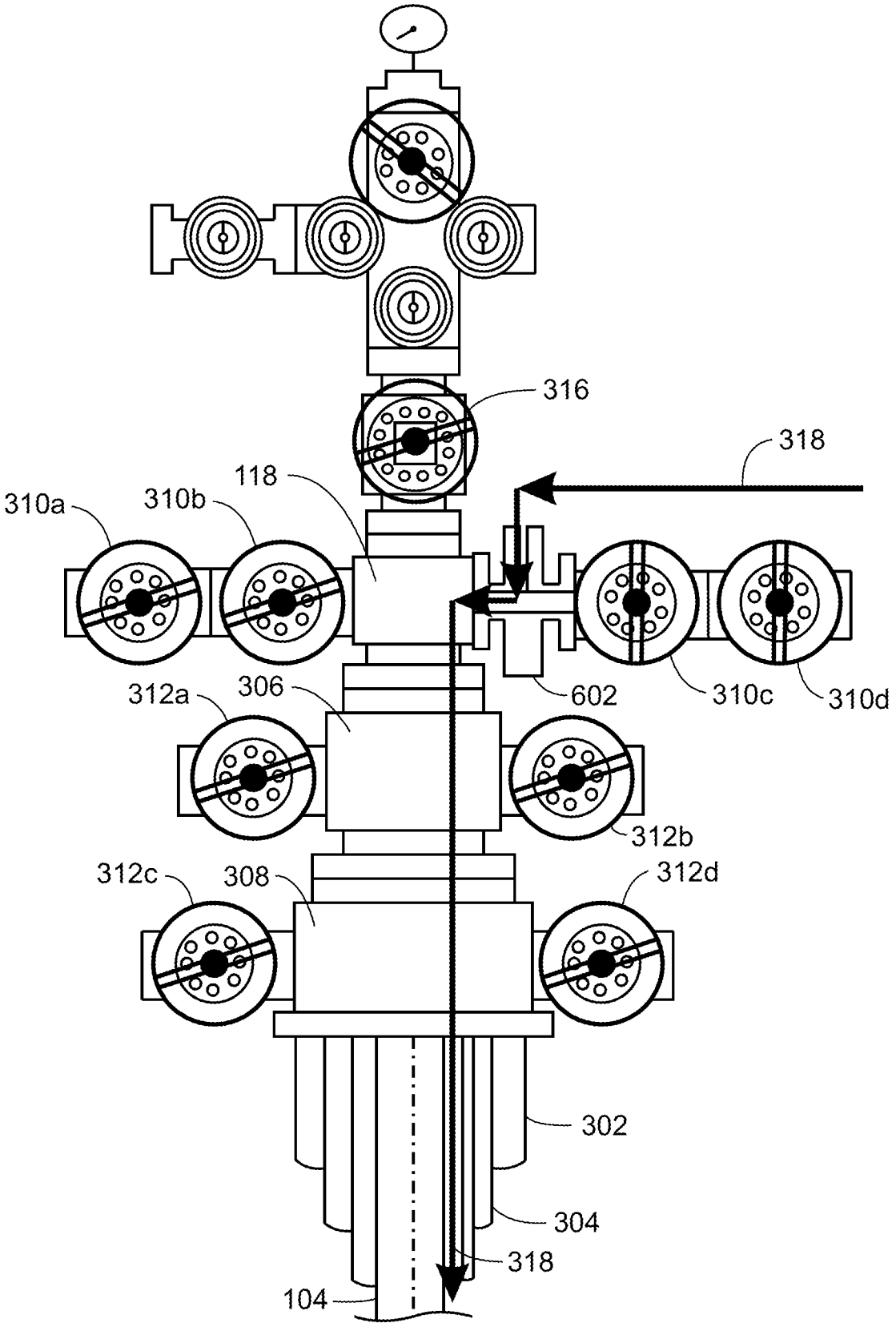
FIG. 6B is a schematic diagram of flowing chemicals through the wellbore chemical injection assembly of FIG. 6A.

FIG. 6A is a schematic diagram of a wellhead together with a Christmas tree including a tubing spool to which a second implementation of a wellbore chemical injection system is connected. The second implementation of the wellbore chemical injection system can include all components of the wellbore chemical injection system 200 (FIG. 2) except for the wellbore chemical injection assembly 102 (FIG. 2). Instead, the wellbore chemical injection system of FIG. 6A can include a different wellbore chemical injection assembly 602. As described below with reference to FIGS. 7A and 7B, the assembly 602 includes an extension member that extends from a sidewall of an extension flange, and that defines an opening through which chemicals are injected through the assembly 602. Thus, whereas the assembly 102 is constructed to flow chemicals from an axial end to an axial end of the extension flange, the assembly 602 is constructed to flow the chemicals through an inlet that is formed on the side wall of the extension flange such that the chemicals flow transverse to the longitudinal axis of the extension flange. FIG. 6B is a schematic diagram of flowing chemicals through the wellbore chemical injection assembly of 602. The arrows 604 schematically show the direction of injection and flow of the chemicals.

Figure 7A:
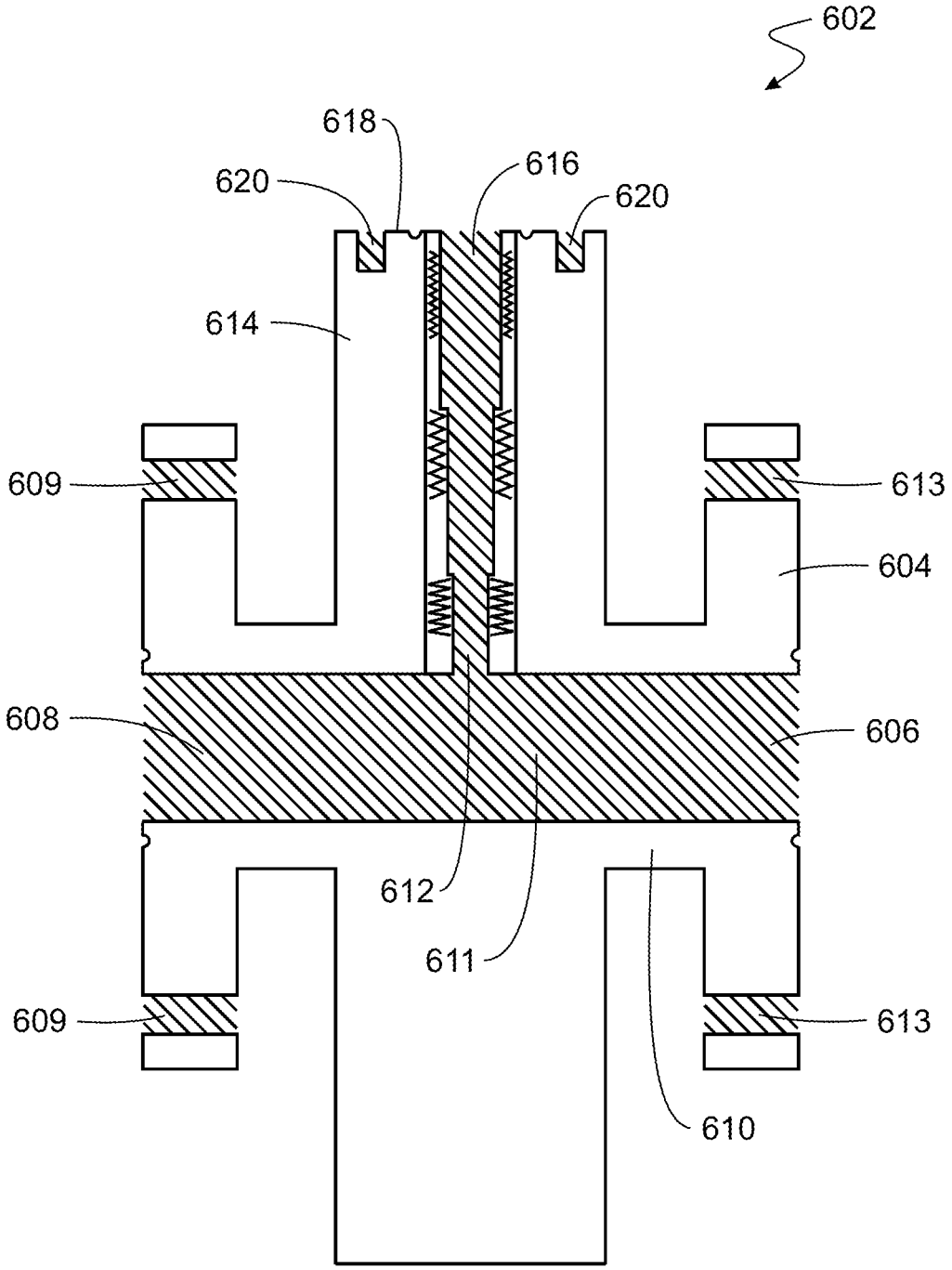
FIGS. 7A and 7B are schematic diagrams of the wellbore injection assembly implemented in the second implementation.
Figure 7B:
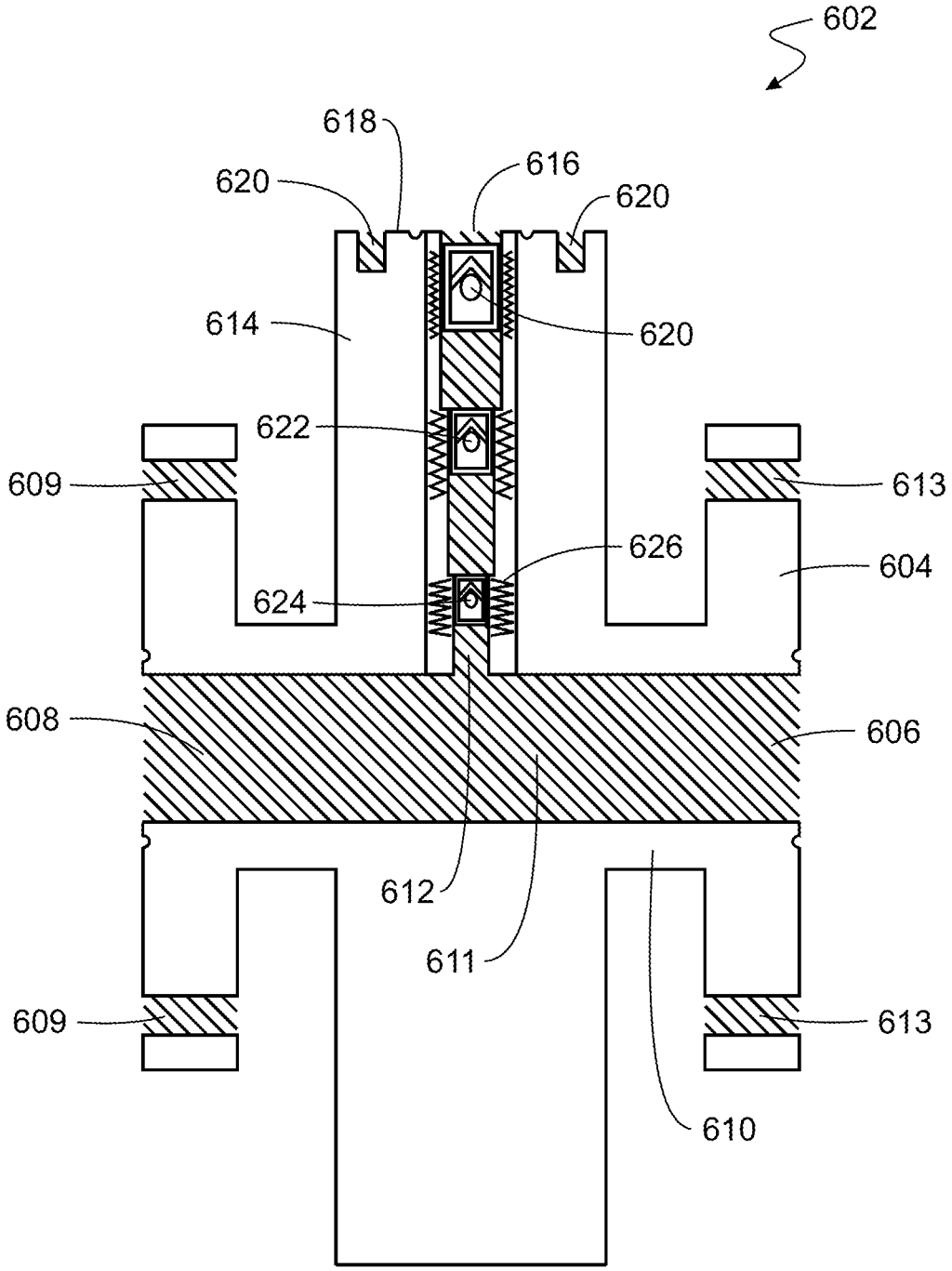

FIGS. 7A and 7B are schematic diagrams of the wellbore injection assembly 602. The assembly 602 includes an extension flange 604 that includes a first end 606 and a second end 608 opposite (i.e., axially opposite) the first end 606. The extension flange 604 includes a flange wall 610 between the first end 606 and the second end 608. The first end 604 is configured to be fluidically coupled to an inlet of a tubing spool (e.g., the tubing spool 118) of a wellhead (e.g., the wellhead 116) installed at a surface of a wellbore (e.g., the wellbore 100) formed through a subterranean zone (e.g., the zone 104). To do so, flange bolt holes 609 are formed on the second end 608 using which the assembly 602 can be bolted to the tubing spool 118. The second end 608 is configured to be fluidically coupled to a fluidic outlet of the wellhead, e.g., to gate valves 310*c*, 310*d* (FIG. 3A). To do so, flange bolt holes 613 are formed on the first end 604 using which the assembly 602 can be bolted to the gate valves 310*c*, 310*d*.

The extension flange 604 defines an inlet 612 on the flange wall 610. For example, the inlet 612 can be a through opening from an outer surface of the flange wall 610 to the interior opening (i.e., the flange bore 611) defined by the extension flange 604. In some implementations, the inlet 612 is formed equidistantly from the first end 604 and the second end 604. In some implementations, the inlet 612 can be nearer to one end than the other.

An extension member 612 is attached to the flange wall 610 at the inlet 612. For example, the extension member 612 can be a tubular structure made of the same material as the flange wall 610. The tubular structure can be attached (e.g., welded or manufactured directly into the flange body) to the flange wall 610 at the inlet 612 at a non-zero angle (e.g., substantially perpendicular or other non-zero angle) with respect to the flange wall 610. Like the flange bore 611 of the extension flange 604, the extension member 612 also defines an interior opening 616.

In some implementations, the interior opening 616 can have a uniform inner diameter along an axial length of the interior opening 616. In some implementations, the axial length of the extension member 614 can define a through opening of increasing inner diameter from the inlet 612 towards an end 618 of the extension member 614. The end 618 is configured to be fluidically coupled to a chemical reservoir (e.g., the chemical reservoir 202 (FIG. 2)) from which chemical is injected through the extension member 614 and the flange bore 611 of the extension flange 604 into the tubing spool 118. The end 618 can be coupled to the chemical reservoir with or without additional surface check valve or surface gate valve, which may be used between wellhead injection flange and chemical injection surface lines. The end face of the end 618 can include profiles (e.g., connection profiles) to fluidically couple the end 618 to the chemical reservoir, other components of the wellbore chemical injection system 202 (FIG. 2) or to a VR lubricator, as described earlier with reference to FIG. 4B.

As shown in FIGS. 7A and 7B, the assembly 602 includes multiple valves (e.g., valves 620, 622, 624) in the through opening 616 of the extension member 614. The valve 620 is an inner valve installed nearest to the inlet 612 formed on the flange wall 610 and farthest from the end 618. The valve 624 is an upper valve installed nearest to the end 618 and farthest from the inlet 612. The middle valve 622 is installed equidistantly from the valve 620 and the valve 624. Each of the multiple valves is a check valve that seals to the inner wall of the through opening 616 and prevents fluid flow in only one direction, i.e., from the end 618 to the inlet 612.

In some implementations, the multiple valves are sized differently to seal the through opening 614 of increasing diameter. For example, an outer diameter of each of the multiple valves can be different and can be sized to match an inner diameter of the location in the through opening 614 in which the respective valve is installed. In implementations in which the through opening 616 is sized to have a decreasing inner diameter along the axial length from the inlet 612 to the end 618, the outer diameter of the valve 620 can be sized so that the valve 620 can be seated near the inlet 612 where an inner diameter of the through opening 614 is the narrowest. The outer diameter of the valve 622 can be greater than that of the valve 620, and the outer diameter of the valve 624 can be greater than that of the valve 622. In this manner, each valve can be sized to be seated to seal along an axial length of the extension member 614.

In implementations in which the through opening 616 has a uniform inner diameter along its length from the inlet 612 to the end 618, a valve 626 can be installed within the through opening 616, for example, in a manner similar to which the valve 424 (FIG. 4A) was installed within the interior opening 420 (FIG. 4A) of the mandrel 414 (FIG. 4A) using coupling threads and sealing elements. In such implementations, the through opening 616 can be formed to have decreasing inner diameter along an axial length of the through opening 616 from the inlet 612 to the end 618. The valves 620, 622, 624 can be installed in the interior opening defined by the through opening 616 along the axial length of the through opening 616.

Figure 8A:
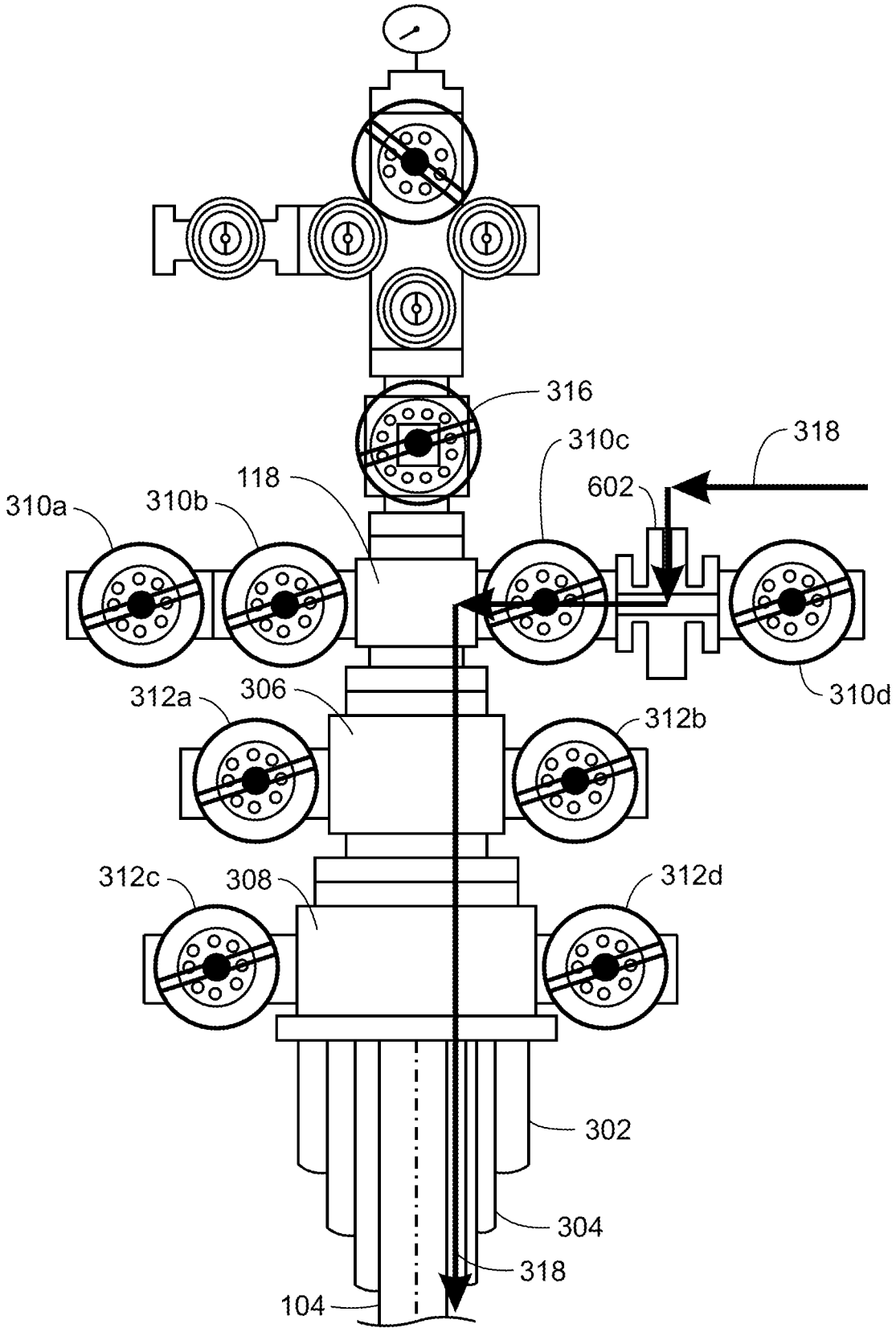
FIGS. 8A, 8B and 8C are different arrangements implementing the second implementation.
Figure 8B:
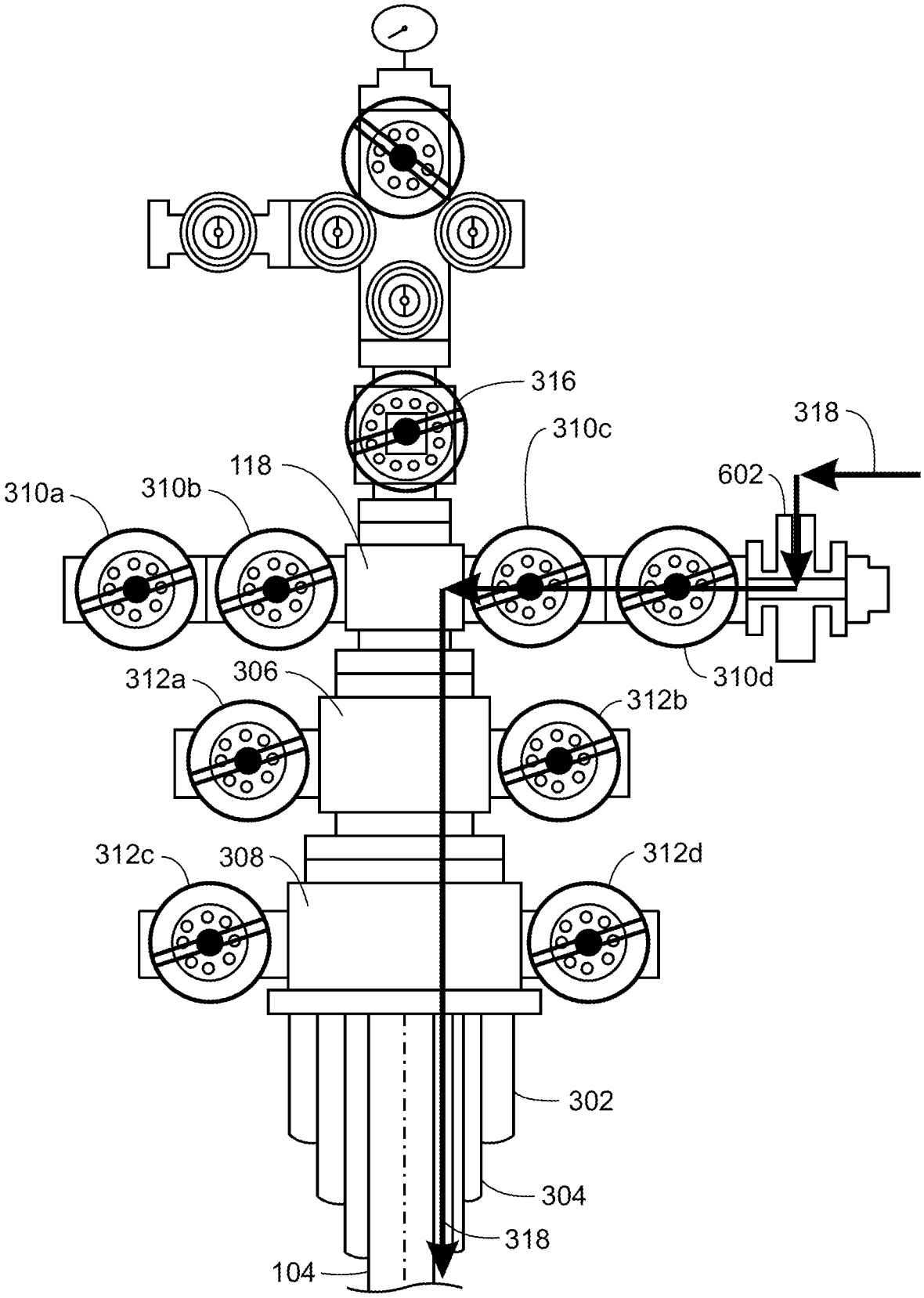
Figure 8C:
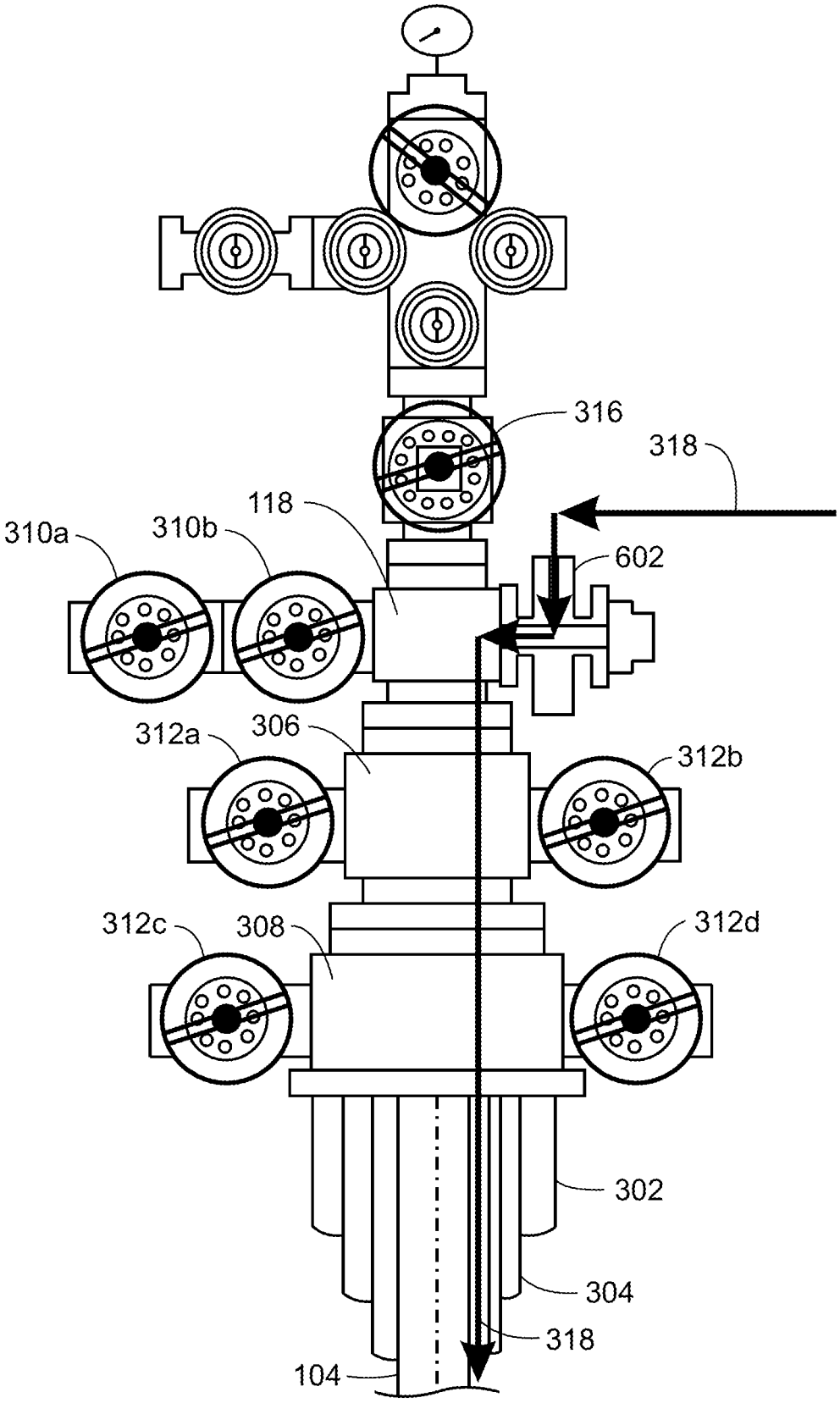

FIGS. 8A, 8B and 8C are different arrangements implementing the assembly 602. In the arrangement of FIG. 8A, the assembly 602 is installed between the gate valves 310*c* and 310*d*. In this arrangement, an outlet of the gate valve 310*c* is fluidically coupled to an inlet of the tubing spool 118. The end 608 of the assembly 602 is fluidically coupled to an outlet of the gate valve 310*c*. The end 606 of the assembly 602 is fluidically coupled to an outlet of the gate valve 310*d*. The inlet of the gate valve 310*d* can be closed to fluid flow or coupled to an interface that allows fluidically coupling the inlet of the gate valve 310*d* to other flow equipment.

In the arrangement of FIG. 8B, the gate valves 310*c* and 310*d* are installed between the inlet to the tubing spool 118 and the assembly 602. In such an arrangement, the end 608 of the assembly 602 can be fluidically coupled to the inlet to one of the gate valves, and the end 606 can be closed to fluid flow or coupled to an interface that allows fluidically coupling the end 606 to other flow equipment. In the arrangement of FIG. 8C, the gate valves are omitted, and the end 606 is closed to fluid flow. In all the arrangements that implement the assembly 602, the chemicals are injected through the end 618 of the extension member 614 such that the chemicals flow transverse to the interior opening 611 for the length of the extension member 614, and then flows along a longitudinal axis of the interior opening 611 prior to flowing into the tubing spool 118.

Figure 9:
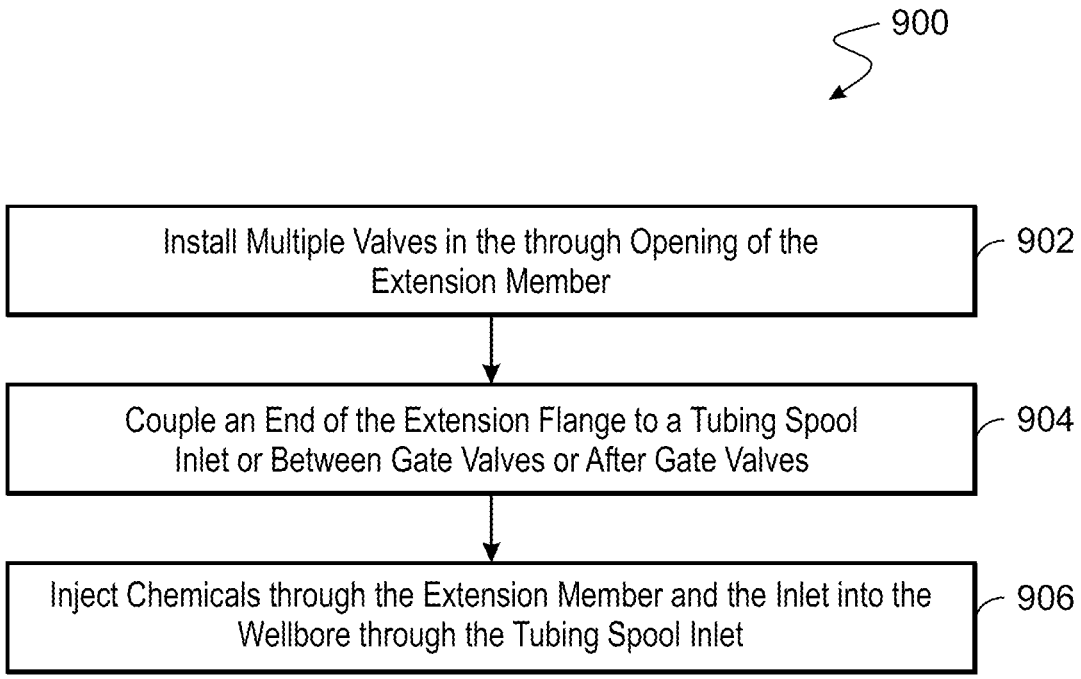
FIG. 9 is a flowchart of an example of a process of implementing the wellbore chemical injection assembly of FIG. 6A.

FIG. 9 is a flowchart of an example of a process 900 of implementing the wellbore chemical injection assembly 602. The process 900 can be implemented by a well operator. At 902, multiple valves (e.g., valves 620, 622, 624) are installed in the through opening of the extension member 614. At 904, an end of the extension flange is coupled to a tubing spool inlet or between gate valves or after gate valves. At 906, chemicals are injected through the extension member 614 and the inlet 612 into the wellbore 100 through the inlet to the tubing spool 118.

In some implementations, the valve 626 is installed in the through opening of the extension member 614. The valve 626 has increasing inner diameters from the inlet 612 towards the end 616 of the extension member 616. The multiple valves are installed in the flange body. During operation, if a chemicals leak is detected in the valve 626, then the injection of chemicals through the extension member 614 is ceased, e.g., by turning off the HP pump 206 (FIG. 2). Then, the valve assembly can be removed from within the through opening of the extension member 614. If there are two gate valves between chemical injection flange and tubing spool, then both gate valves are closed and the trap pressure is bled. After that, the flange is removed, and the check valves are safely replaced for installation. In particular, the valve assembly can be removed without needing to de-couple the extension flange 604 from the gate valves 310*c*, 310*d*.

Thus, particular implementations of the subject matter have been described. Other implementations are within the scope of the following claims.

The invention claimed is:

1. A wellbore chemical injection assembly comprising:

an extension flange comprising a first end and a second end opposite the first end, the extension flange defining a flange bore between the first end and the second end, the first end configured to be fluidically coupled to a tubing spool inlet of a wellhead installed at a surface of a wellbore formed through a subterranean zone, the second end configured to be fluidically coupled to a chemical reservoir from which chemical is injected through the flange bore into the tubing spool;

a mandrel positioned within the extension flange, a portion of the mandrel residing within the flange bore, a remainder of the mandrel extending out of the extension flange, the mandrel defining an interior opening spanning an axial length of the mandrel;

outer coupling threads formed on an outer surface of the remainder of the mandrel, the outer coupling threads configured to removably mate with counterpart threads in the tubing spool inlet;

inner coupling threads formed on an inner surface of a portion of the interior opening; and a valve assembly removably seated in the interior opening, the valve assembly comprising valve coupling threads on an outer surface of the valve assembly, the valve coupling threads configured to removably mate with the inner coupling threads formed on the inner surface of the portion of the interior opening.

2. The assembly of claim 1, wherein the valve assembly comprises:

a valve seat seated in the interior opening; and a plurality of check valves installed in the valve seat, the plurality of check valves configured to permit flow of the chemical in one direction through the interior opening and prevent flow of the chemical in the opposite direction.

3. The assembly of claim 2, wherein an inner diameter of the portion of the interior opening with the inner coupling threads is greater than an inner diameter of the remainder of the mandrel with the outer coupling threads.

4. The assembly of claim 3, wherein the valve seat includes a first segment and a second segment, wherein an outer diameter of the first segment is greater than an outer diameter of the second segment, wherein the first segment is seated in the portion of the interior opening with the greater inner diameter, wherein the second segment is seated in the portion of the interior opening with the smaller inner diameter.

5. The assembly of claim 4, wherein the plurality of check valves are installed in the second segment.

6. The assembly of claim 1, wherein the outer coupling threads form a metal-to-metal seal with the tubing spool inlet.

7. The assembly of claim 6, wherein the outer coupling threads are sharp vee threads or ACME threads.

8. The assembly of claim 1, wherein the flange bore is oriented parallel to a flow of the chemical into the tubing spool inlet.

9. A method comprising:

installing a valve assembly in an interior opening that spans an axial length of a mandrel by removably mating valve coupling threads on an outer surface of a first segment of the valve assembly with inner coupling threads on an inner surface of a portion of the interior opening;

positioning the mandrel with the valve assembly within a flange bore defined between a first end and a second, opposite end of an extension flange, wherein a portion of the mandrel resides within the flange bore and a remainder of the mandrel extends out of the extension flange, wherein outer coupling threads are formed on an outer surface of the remainder of the mandrel;

coupling the outer coupling threads formed on the outer surface of the remainder of the mandrel with counterpart threads in a tubing spool inlet of a wellhead installed at a surface of a wellbore formed through a subterranean zone; and injecting chemicals through the mandrel and the valve assembly into the wellbore through the tubing spool inlet.

10. The method of claim 9, further comprising:

determining a chemicals leak in the valve seat; and in response to determining the chemicals leak in the valve seat:

ceasing injecting the chemicals through the mandrel and the valve assembly, and removing the valve assembly from the interior opening by de-coupling the valve coupling threads with the inner coupling threads while retaining the mandrel within the flange bore.

11. The method of claim 9, further comprising:

determining a chemicals leak in the flange bore; and in response to determining the chemicals leaks in the flange bore:

ceasing injecting the chemicals through the mandrel and the valve assembly, and removing the mandrel through the flange bore while retaining the valve assembly within the interior opening while retaining the flange bore in place.

12. The method of claim 9, wherein coupling the outer coupling threads formed on the outer surface of the remainder of the mandrel with counterpart threads in the tubing spool inlet comprises orienting the flange bore parallel to a flow of the chemical into the tubing spool inlet.

13. The method of claim 9, wherein the valve assembly comprises:

a valve seat; and a plurality of check valves configured to permit flow of the chemical in one direction through the interior opening and prevent flow of the chemical in the opposite direction, wherein the method further comprises seating the valve seat in the interior opening and installing the plurality of check valves in the valve seat.

14. The method of claim 13, wherein an inner diameter of the portion of the interior opening with the inner coupling threads is greater than an inner diameter of the remainder of the mandrel with the outer coupling threads, wherein the valve seat includes a first segment and a second segment, wherein an outer diameter of the first segment is greater than an outer diameter of the second segment, wherein the method further comprises:

seating the first segment in the portion of the interior opening with the greater inner diameter; and seating the second segment in the portion of the interior opening with the smaller inner diameter.

15. The method of claim 14, further comprising seating the plurality of check valves in the second segment.

16. A wellbore chemical injection system comprising:

a chemical reservoir storing chemicals to be injected into a wellbore formed in a subterranean zone through a wellhead installed at a surface of the wellbore, the wellhead comprising a tubing spool having a tubing spool inlet configured to receive the chemicals from the chemical reservoir;

a flowline fluidically coupled to the chemical reservoir, the flowline configured to flow the chemicals from the chemical reservoir to the tubing spool inlet; and a wellbore chemical injection assembly comprising:

an extension flange comprising a first end fluidically coupled to the tubing spool inlet and a second end opposite the first end, the second end fluidically coupled to the flowline, the extension flange defining a flange bore between the first end and the second end;

a mandrel coupled to the extension flange, the mandrel residing partially within and partially outside the flange bore, the mandrel defining an interior opening spanning an axial length of the mandrel;

outer coupling threads formed on an outer surface of a portion of the mandrel residing outside the flange bore, the outer coupling threads configured to removably mate with counterpart threads in the tubing spool inlet;

inner coupling threads formed on an inner surface of a portion of the interior opening; and a valve assembly removably seated in the interior opening, the valve assembly comprising valve coupling threads on an outer surface of the valve assembly, the valve coupling threads configured to removably mate with the inner coupling threads formed on the inner surface of the portion of the interior opening.

17. The system of claim 16, wherein the valve assembly comprises:

a valve seat seated in the interior opening; and a plurality of check valves installed in the valve seat, the plurality of check valves configured to permit flow of the chemical in one direction through the interior opening and prevent flow of the chemical in the opposite direction.

18. The system of claim 17, wherein an inner diameter of the portion of the interior opening with the inner coupling threads is greater than an inner diameter of the remainder of the mandrel with the outer coupling threads.

19. The assembly of claim 18, wherein the valve seat includes a first segment and a second segment, wherein an outer diameter of the first segment is greater than an outer diameter of the second segment, wherein the first segment is seated in the portion of the interior opening with the greater inner diameter, wherein the second segment is seated in the portion of the interior opening with the smaller inner diameter.

20. The assembly of claim 18, wherein the plurality of check valves are installed in the second segment.

* * * * *